US006392541B1

(12) United States Patent
Bucher et al.

(10) Patent No.: US 6,392,541 B1
(45) Date of Patent: May 21, 2002

(54) THEFT-DETERRENT OUTDOOR LIGHTING

(75) Inventors: John C. Bucher, Ft. Lauderdale; Charles E. Bucher, Valrico; Tien S. Lowe; Chad J. Ricker, both of Ft. Lauderdale, all of FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/724,767

(22) Filed: Nov. 28, 2000

(51) Int. Cl.[7] ..... G08B 13/00

(52) U.S. Cl. ..... 340/541; 340/540; 340/331; 340/332; 340/507; 340/510; 362/431; 362/376

(58) Field of Search ..... 340/541, 540, 340/331, 332, 507, 510; 362/431, 376

(56) References Cited

U.S. PATENT DOCUMENTS 3,866,034 A * 2/1975 Russo ..... 240/2 B
5,036,447 A * 7/1991 Taylor ..... 362/431
5,178,454 A * 1/1993 Lai ..... 362/431
5,337,993 A * 8/1994 Hersman ..... 248/156
5,597,229 A * 1/1997 Plichta et al. ..... 362/153.1
6,135,623 A * 10/2000 Lin ..... 362/431

* cited by examiner

*Primary Examiner*—Daniel J. Wu
*Assistant Examiner*—Tai T. Nguyen
(74) *Attorney, Agent, or Firm*—Holland & Knight LLP

(57) ABSTRACT

A theft-deterrent outdoor lighting fixture having an auger that is connected to the lowermost end of the lighting fixture by means of a one-way clutch mechanism. The one-way clutch mechanist engages or locks the auger relative to the fixture when turned in the same direction of the thread of the auger but free-wheels in the reverse direction to preclude removal of fixture. In another embodiment, the theft-deterrent outdoor lighting includes an electronic design that detects movement representative of theft and sounds an alarm to draw attention to the theft while in progress. In still another embodiment, the theft-deterrent outdoor lighting includes a wiring harness that is destructively severed should the lighting fixture be pulled from the ground, thereby rendering the lighting inoperable in the case of theft.

19 Claims, 8 Drawing Sheets

THEFT-DETERRENT OUTDOOR LIGHTING

FIELD OF THE INVENTION

This invention relates to outdoor lighting, and in particular, to theft-deterrent outdoor lighting.

DESCRIPTION OF THE BACKGROUND ART

Outdoor lighting devices are well known. In the outdoor lighting and landscaping arts, it is customary to illuminate and delineate pathways, driveways, sidewalks, patios, plant beds, and lawns with outdoor lighting. Such lighting is typically used to provide illumination for practical as well as decorative purposes, including highlighting landscaping and various architectural features of various improvements. Presently, there exists a variety of outdoor lighting devices that use a variety of embodiments and power sources.

Unfortunately, the ease of installation of outdoor lighting also renders the lighting susceptible to theft. Moreover, in regard to outdoor lighting that is solar powered, there is no wiring to cut or other deterrents to theft. Thus, the risk of theft is significantly increased.

Therefore, it is an object of this invention to provide an improvement which overcomes the aforementioned inadequacies of the prior art outdoor lighting and provides an improvement which is a significant contribution to the advancement of the outdoor lightning art.

Another object of this invention is to provide outdoor lighting that comprises a theft-deterrent design that reduces the risk of being stolen.

Another object of this invention is to provide theft-deterrent outdoor lighting that includes a base that allows easy installation but difficult removal, thereby significantly deterring theft.

Another object of this invention is to provide theft-deterrent outdoor lighting that includes a motion detector for detecting movement, and an alarm that is actuated once movement is detected to thereby draw attention to the lighting once stolen.

Another object of this invention is to provide theft-deterrent outdoor lighting that includes a wiring harness that is severed if the lighting is improperly removed from the ground as in the case of a theft, such that the functionality of the lighting is destroyed if stolen.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention are set forth in the detailed description of the preferred embodiment in addition to the scope of the invention defined by the claims taken in conjunction with the accompanying drawings.

SUMMARY OF THE INVENTION

For the purpose of summarizing this invention, this invention comprises outdoor lighting that has a theft-deterrent design. More particularly, in one embodiment of the theft deterrent outdoor lighting of the invention, the outdoor lighting includes a mechanical design that allows easy installation but difficult removal. In another embodiment, the theft deterrent outdoor lighting of the invention includes an electronic design that detects movement representative of theft and sounds an alarm to draw attention to the theft while in progress in anticipation of the thief would then simply drop the outdoor lighting and run off leaving the outdoor lighting behind. In a combined mechanical and electrical embodiment, the theft deterrent outdoor lighting of the invention includes a wiring harness that is destructively severed should the lighting be pulled from the ground, thereby rendering the lighting inoperable in the case of theft.

The mechanical and the electrical embodiments of the outdoor lighting of the invention may be incorporated into many types and styles of outdoor lighting. Thus there presently exists many varieties of outdoor lighting in which the theft deterrent outdoor lighting of the invention may be incorporated into within the intended scope of this invention. Furthermore, the theft deterrent outdoor lighting of the invention is particularly useful and desirable for use in connection with implementations that are most susceptible to theft. One example includes low-powered landscape outdoor lighting that is customarily only staked into the ground around the landscaping to be illuminated. Such landscaping outdoor lighting is particularly susceptible of theft because it can be simply pulled from the ground, the external supply wires cut without the fear of electrical shock, and then stolen. Moreover, solar-powered outdoor lighting is even more susceptible of being stolen as there are no external supply wires that require cutting. An example of solar-powered outdoor lighting is that described in our patent application entitled "Solar Powered Light Assembly" filed concurrently herewith and the disclosure of which is hereby incorporated by reference herein.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
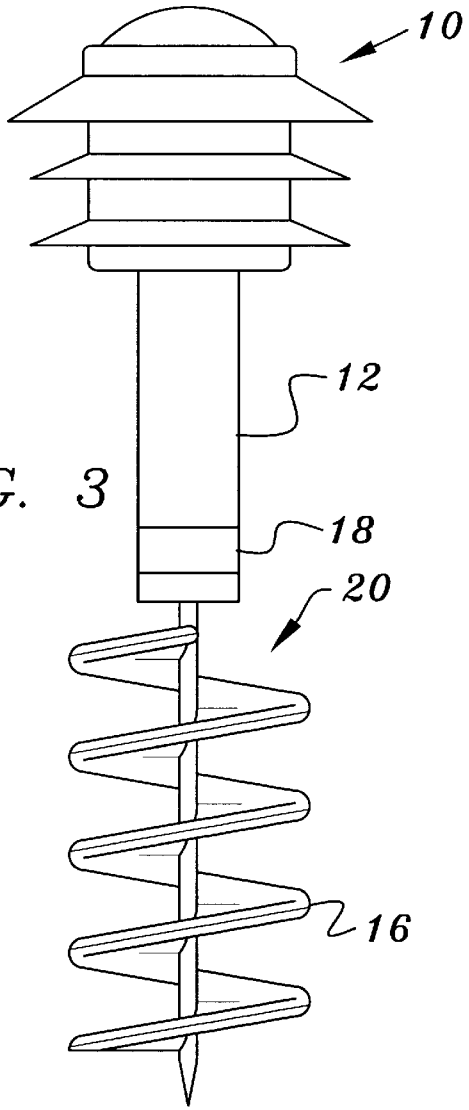
FIG. 1 (Prior Art)
FIG. 1 is a side elevational view of a prior art outdoor lighting design in the form of a landscaping outdoor lighting having a stake for insertion into the ground around the area of the landscaping to be illuminated.

As shown in FIG. 1, a conventional outdoor lighting design for illuminating outdoor landscaping typically comprises a light housing 10 containing a light source connected to the end of an elongated support 12. A spike-shaped stake 14 is connected to the other end of the elongated support 12 allowing the outdoor lighting 10 to be staked into the ground around the landscaping that is desired to be illuminated. Prior art outdoor lighting 10 may be powered by conventional AC or DC electrical current that is typically low-powered to reduce the hazards of inadvertent electrical shock. Other prior art outdoor lighting may be solar-powered.

Figure 2:
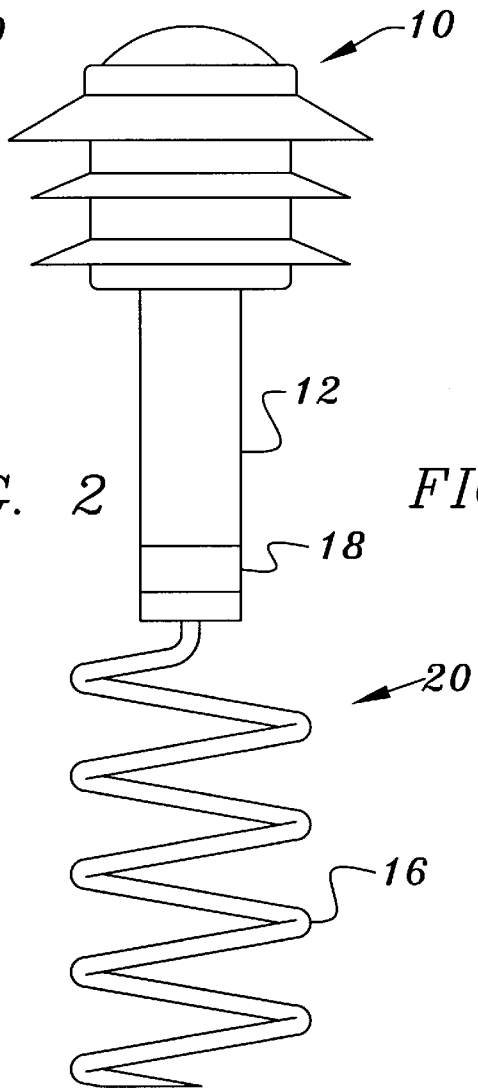
FIG. 2 is a side elevational view of the landscaping outdoor lighting of FIG. 1 modified to include the mechanical embodiment of the theft deterrent outdoor lighting of this invention that includes a one-way auger that can be screwed into the ground but not easily removed without the use of a special tool.

As shown in FIG. 2, the mechanical theft deterrent outdoor lighting 20 of the invention comprises a similar light housing 10 connected to the end of the elongated support 12. However, in lieu of the prior art stake 14 being connected to the other end of the elongated support 12, the theft deterrent outdoor lighting 20 of the, invention employs an auger 16 that is connected to the other end of the elongated support 12 by means of a one-way clutch mechanism 18.

The one-way clutch mechanism 18 may comprise any design that engages or locks the auger 16 with the elongated support 12 when turned in the same direction of the thread of the auger 16 but free-wheels in the reverse direction. For example, in the case of an auger 16 having a right-handed thread, the one-way clutch 18 locks the elongated support 12 to the auger 16 when turned in a clockwise direction to allow the auger 16 to be screwed or augered into the ground but, when turned in a counter-clockwise direction, the one-way clutch 18 disengages the elongated support 12 from the auger 16 and allows it to free-wheel. The auger 16 therefore cannot simply be unscrewed from the ground in the counter-clockwise direction. Rather, in order to remove the theft deterrent outdoor lighting 20 from the ground, it must be firmly grasped and forcibly pulled with enough force to dislodge the auger 16 and the ground surrounding its threads. As the amount of force is substantial, removal is not easy and theft of the theft deterrent outdoor lighting 20 of the invention is therefore significantly deterred.

Figure 3:
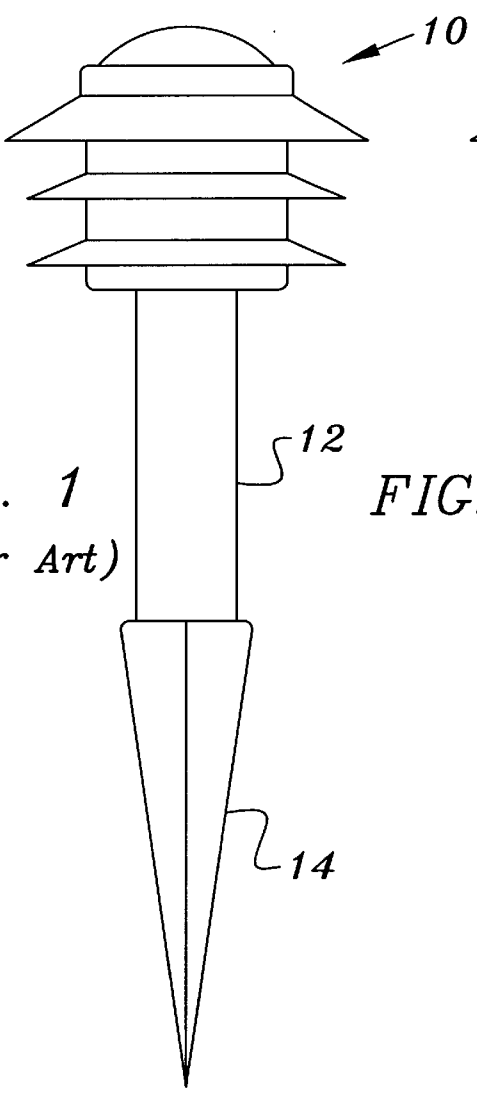
FIG. 3 is a side elevational view of the outdoor lighting of FIG. 2 with a modified auger.

It is noted that the auger 16 depicted in FIG. 2 comprises a rigid wire that is bent in the shape of a corkscrew to form the thread for threading into the ground. However, as shown in FIG. 3, the auger 16 may comprise a solid thread design. With this solid thread design, the auger 16 has added strength and, when augered into the ground, results in increased difficulty in being removed from the ground (over the wire corkscrew design of FIG. 2) due to its solid thread design.

Figure 4:
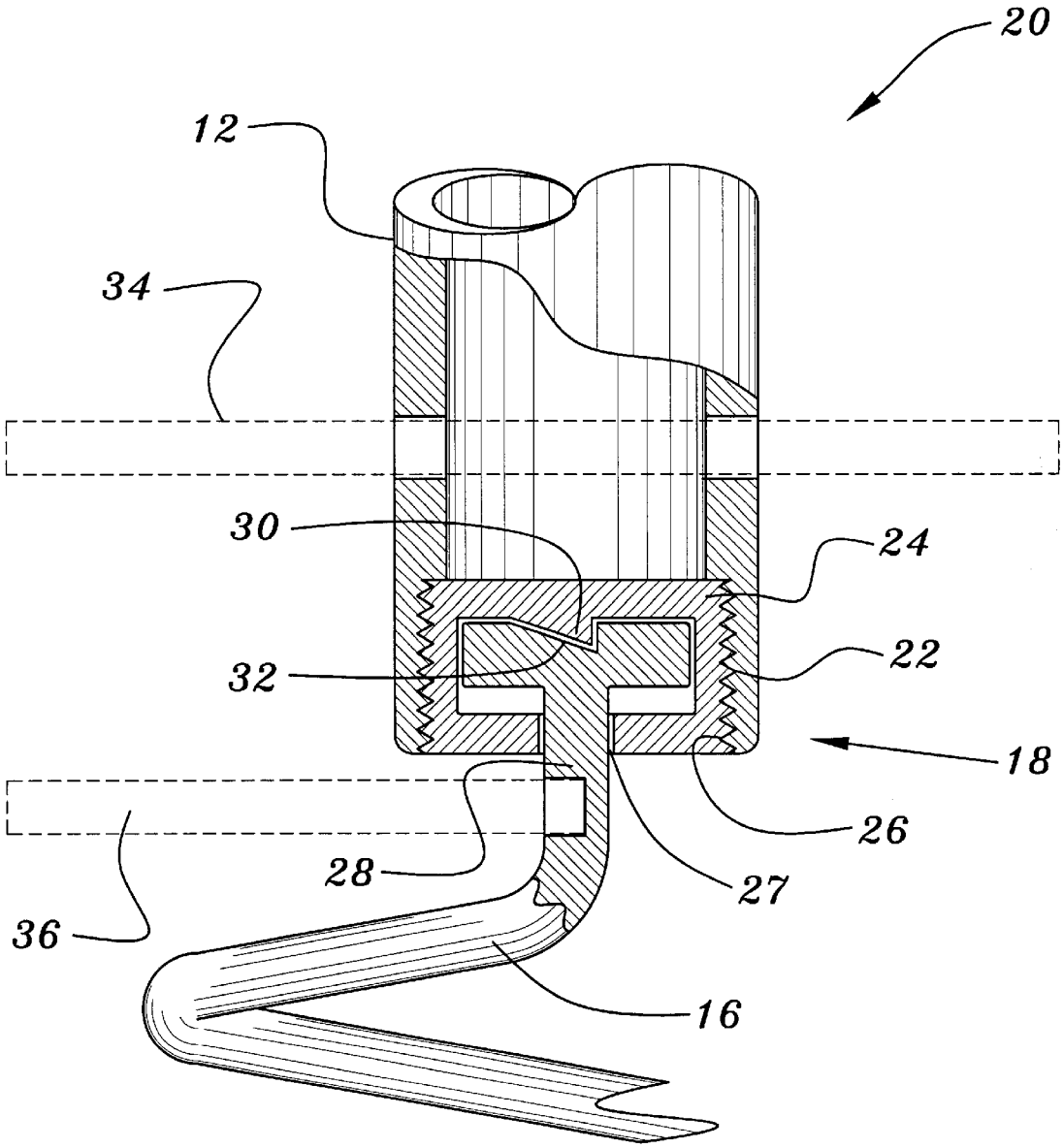
FIG. 4 is a partial cross-sectional view of the one-way clutch mechanism that interconnects the outdoor lighting to the auger to allow easy augering into the ground in one direction and "free-wheeling" in the opposite direction to prevent easy removal from the ground once installed.

FIG. 4 is a partial cross-sectional view of one embodiment of a one-way clutch 18 that may be employed in the theft deterrent outdoor lighting 20 of this invention. More particularly, in the is preferred embodiment, the end of the elongated support 12 includes an internal thread 22. A base, generally indicated by numeral 24, comprises an inverted cup-shaped design with an external thread 26 for threaded engagement with the internal thread 22 of the end of the elongated support 12. The proximal end 28 of the auger 16 is fitted through a hole 30 in the bottom wall of the cup-shaped base 24 and is dimensioned to allow slight vertical movement and rotation therein. The proximal end 28 interconnects the cup-shaped base 24 with the auger 16 by means of dogs 30 extending from the top wall of the cup-shaped base 24 that engage and lock into corresponding ramped slots 32 formed in the mating surface of the proximal end 28 of the auger, 16 when pushed downwardly turned in one direction and that release from the slots 32 when turned in the opposite direction. A tool 34 may be provided to ease installation.

It is noted that the theft deterrent outdoor lighting 20 of the invention cannot be easily removed from the ground due to the free-wheeling of the one-way clutch 18, and therefore deters theft. However, during re-landscaping, it also deters repositioning of the outdoor lighting 20 to another desired location around the landscaping to be illuminated. In order to bypass the operation of the one-way clutch 18, the theft deterrent outdoor lighting 20 of the invention may be sold with a tool 36, as shown in FIG. 4, that is designed to engage directly into the auger 16. With the use of such tool 36, the auger 16 can be turned in the direction opposite to its thread, thereby allowing easy removal of the theft deterrent outdoor lighting 20 from the ground.

Figure 5:
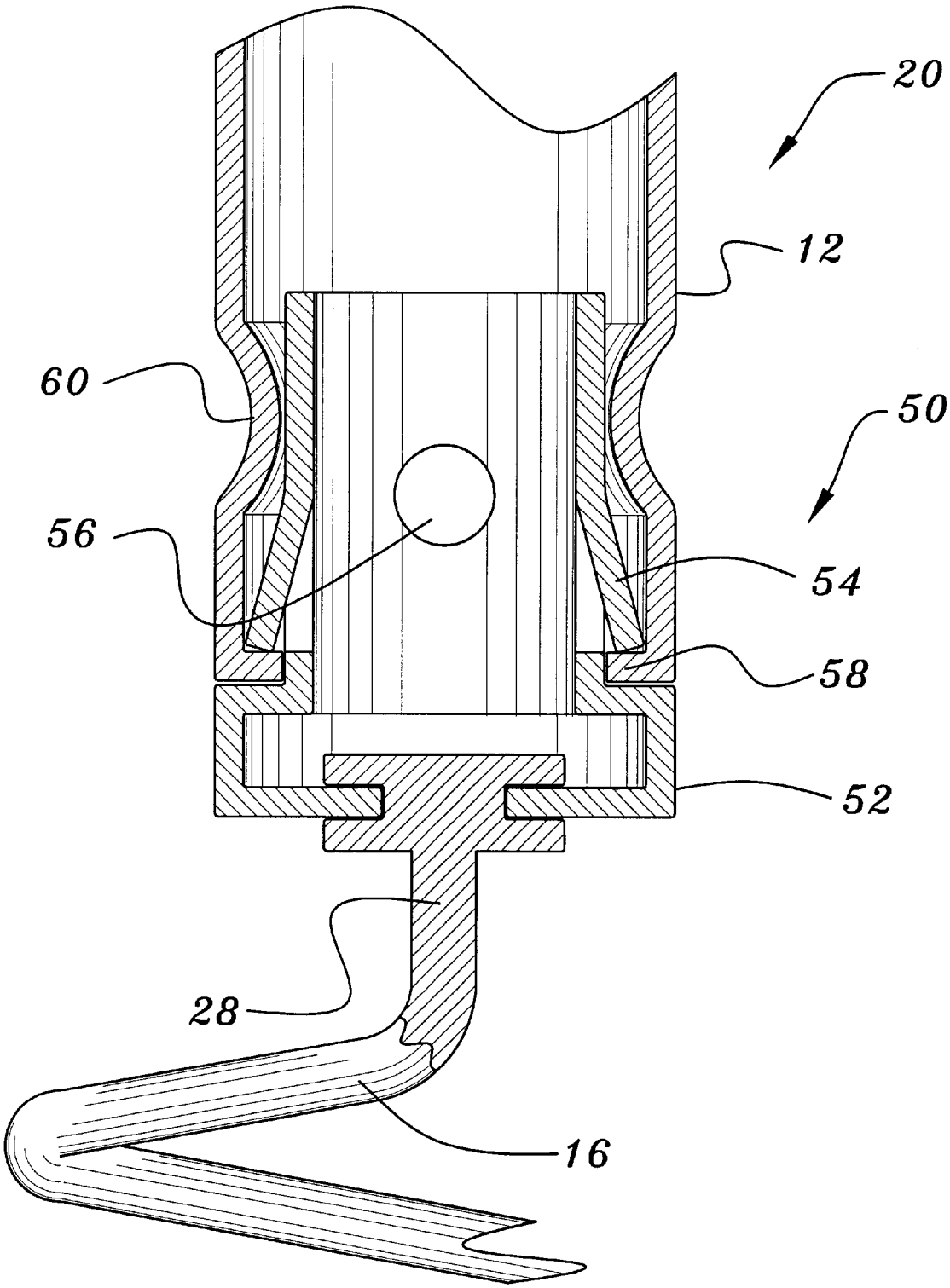
FIG. 5 is a partial cross-sectional view of the snap-on mechanism that interconnects the outdoor lighting to the auger to allow easy augering into the ground through the use of a tool and subsequent "free-wheeling" once augered into the ground once installed to prevent easy removal thereof without the use of the tool.

FIG. 5 is a partial cross-sectional view of another embodiment of a snap-on mechanism 50 that allows the auger 16 to be augured into the ground through the use of a tool (not shown) and precludes removal by an elongated support 12 that is then connected to prevent the auger 16 from being unthreaded from the ground. More particularly, in this embodiment, the snap-on mechanism 50 comprises a base 52 having a bottom wall to which is inserted the proximal end 28 of the auger 16. The proximal end 28 is then clamped into position to prevent any longitudinal or rotational movement thereof between the base 52 and the auger 16. Base 52 comprises a substantially cylindrical design having an upstanding wall through which is formed a transverse hole 56. As should be appreciated, by inserting a tool through the transverse hole 56, the auger 16 may be augured into the ground by simple rotation of the tool. In order to conceal the transverse hole 56 and otherwise prevent access thereto for unthreading the auger 16 from the ground, the elongated support 12 comprises a lower end which fits over the upper wall of the base 12, thereby concealing the transverse hole 56 and preventing access thereto. In order to prevent removal of the elongated support 12 from the base 52, the base 52 may comprise a plurality of tabs 54 that are biased outwardly from its upper side wall. The edge end 58 of the elongated support comprises a generally turned-in configuration that serves to push the tabs 54 inwardly and snap over them during installation of the elongated support 12 onto the base 52. It is noted that once the inturned end 58 of the elongated support snaps over the tabs 54, tabs 54 engage against and therefore lock against the inturned ends 58, thereby preventing the elongated support 12 from being removed from the base 52. Furthermore, it is noted that the elongated support 12 may freely rotate relative to the base 52 thereby preventing the unthreading of the auger 16 from the ground. Finally, it is noted that the elongated support 12 may comprise an annular indentation 60 of close tolerances to the upper wall of the base 52 to provide a tight fit.

Figure 6:
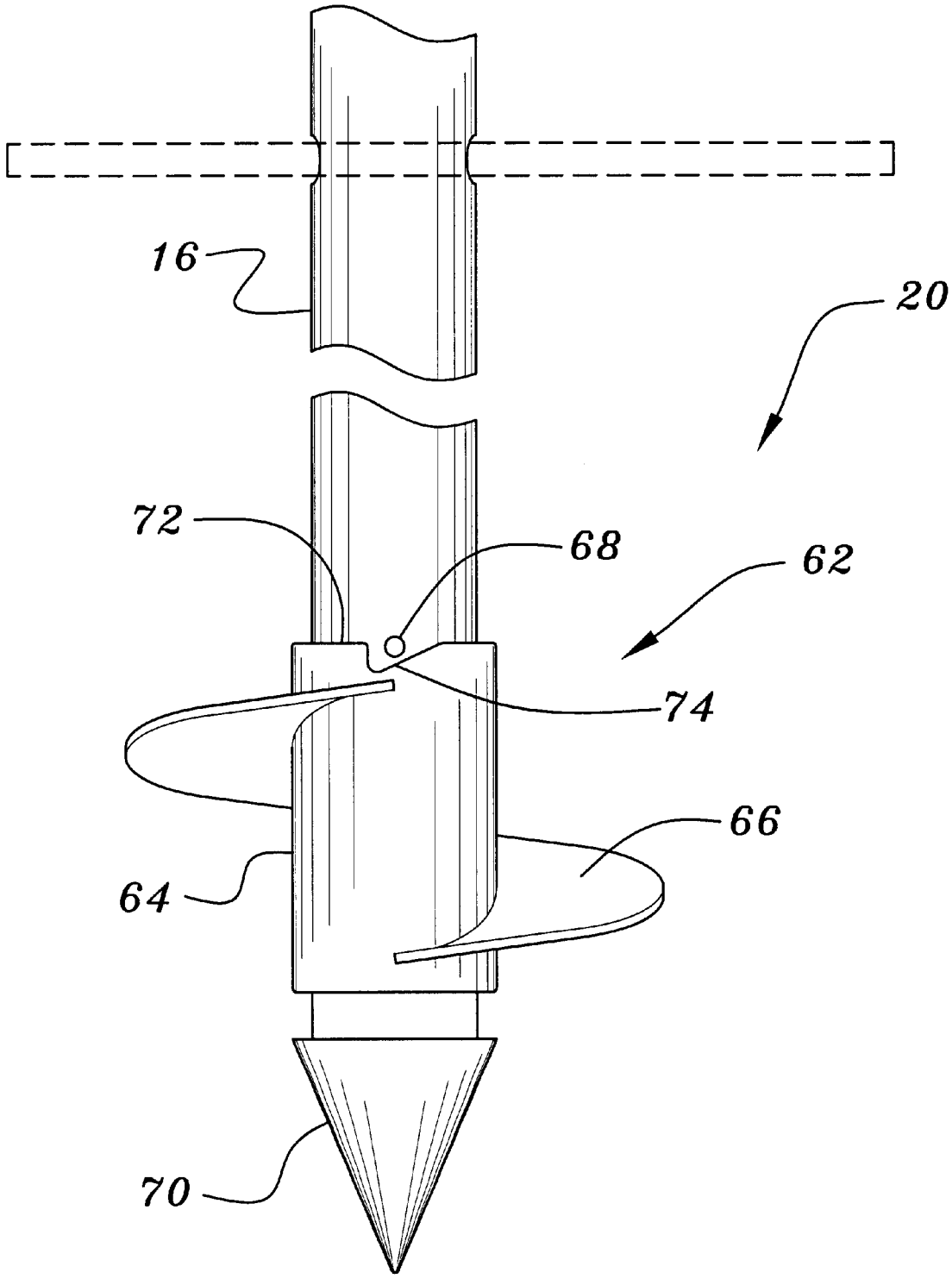
FIG. 6 is a partial side view of another one-way auger mechanism that allows easy augering into the ground in one direction and "free-wheeling" in the opposite direction to prevent easy removal thereof once installed.

As shown in FIG. 6, another embodiment of another one-way auger mechanism 62 is provided which allows the outdoor lighting 20 to be augured into the ground but not removed. More particularly, the auger 16 comprises a generally cylindrical design having its lowermost end configured in a point configuration 70 with an enlarged diameter allowing it to easily penetrate the ground. An auger collar 64 of a generally cylindrical design is fitted over the auger 16 and is allowed to freely rotate thereabout. A stop pin 68 is positioned transversely through the auger 16 at a distance from the point 70 that is appreciably greater than the length of the auger collar 64. Thus, the auger collar 64 is allowed to rotate around the auger 16 and move slightly up and down between the stop pin 68 in the enlarged diameter of the point 70.

The auger collar 64 includes one or more auger blades 64 that are configured (e.g., right-handed) to auger into the ground upon rotation. The upper end 72 of the auger collar 64 comprises a pair of diametrically-opposing sloped slots 74. The sloped notches 74 are sloped in a direction to engage the stop pin 68 when the auger collar 64 is forced upwardly and rotated in the direction of its thread a "lock" position and to release when rotated in a direction counter to the direction of its thread. For example, as shown in FIG. 6, the auger thread 66 comprises a right-handed thread. When the point 20 of the auger 16 is initially forced into the ground, the auger collar 64 moves upwardly and upon clockwise rotation of the auger 16, the diametrically protruding ends of the stop pin 68 engages within the respective sloped slots 74. The auger 16 is thus locked to the auger collar 64. This allows further clockwise rotation of the auger 16 to auger the blades 66 into the ground.

If the auger 16 is counter rotated in a reverse direction, the protruding ends of the stop pins 68 would simply run out of the slots 74, thereby allowing the auger 16 to free-wheel in such reverse direction. Removal of the auger 16 from the ground would therefore be precluded.

Figure 7:
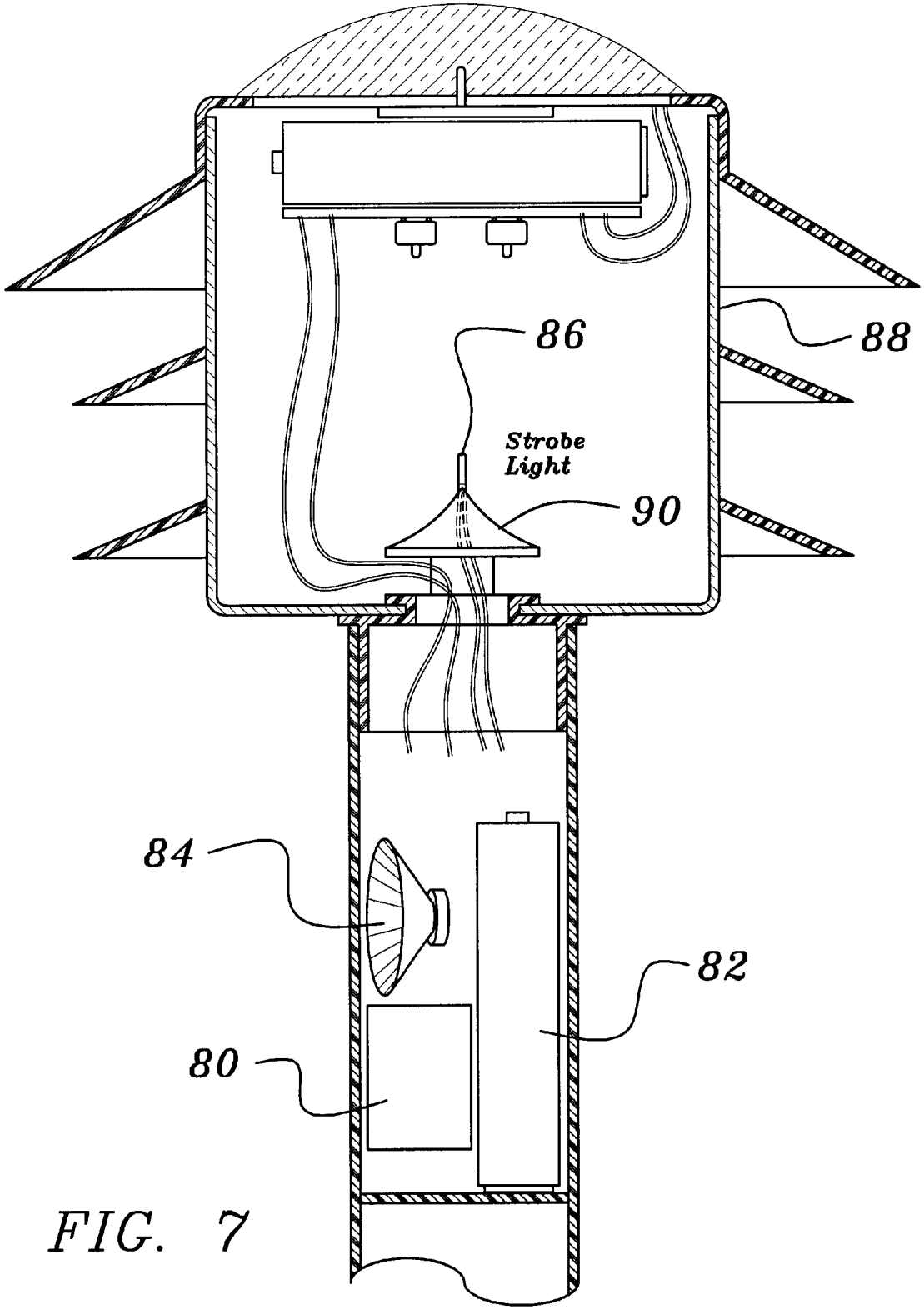
FIG. 7 is a partial cross-sectional view of the Solar Powered Lighting Fixture of our aforementioned patent application filed concurrently herewith, modified to include an electronic embodiment of the theft deterrent outdoor lighting of this invention that employs a motion detector.

As shown in FIG. 7, one electronic embodiment of the theft deterrent outdoor lighting 20 of the invention may comprise a motion sensor 80 that controls the flow of electrical energy from a battery 82 to an audible alarm 84. The motion sensor 80 may comprise a normally-open mercury switch having its contacts connected in series with the terminals of the alarm 84 and the battery 82. Upon tilting movement of the mercury switch, indicative of the theft deterrent outdoor lighting being stolen by being removed from the ground, its contacts close to supply electrical energy from the battery 82 to flow to the alarm 84 and causing it to sound. Upon sounding of the alarm 84, the public's attention is drawn to the theft deterrent outdoor lighting 20. Thus, instead of absconding with the theft deterrent outdoor lighting 20, the would-be thief would tend to drop it and run away. It is noted that the alarm 84 may be of the type that produces sound of varying frequencies to further increase the attention that is drawn to it when the alarm sounds.

For added attention-grabbing, the theft deterrent outdoor lighting of the invention may further include a strobe light 86 electrically connected to the motion detector 80. Upon detecting motion, electrical energy is supplied to the strobe light 86 causing it to strobe. As shown in FIG. 5, the strobe light may be positioned within the light housing 88 above the internal reflector 90 to increase the illumination during strobing.

Figure 8:
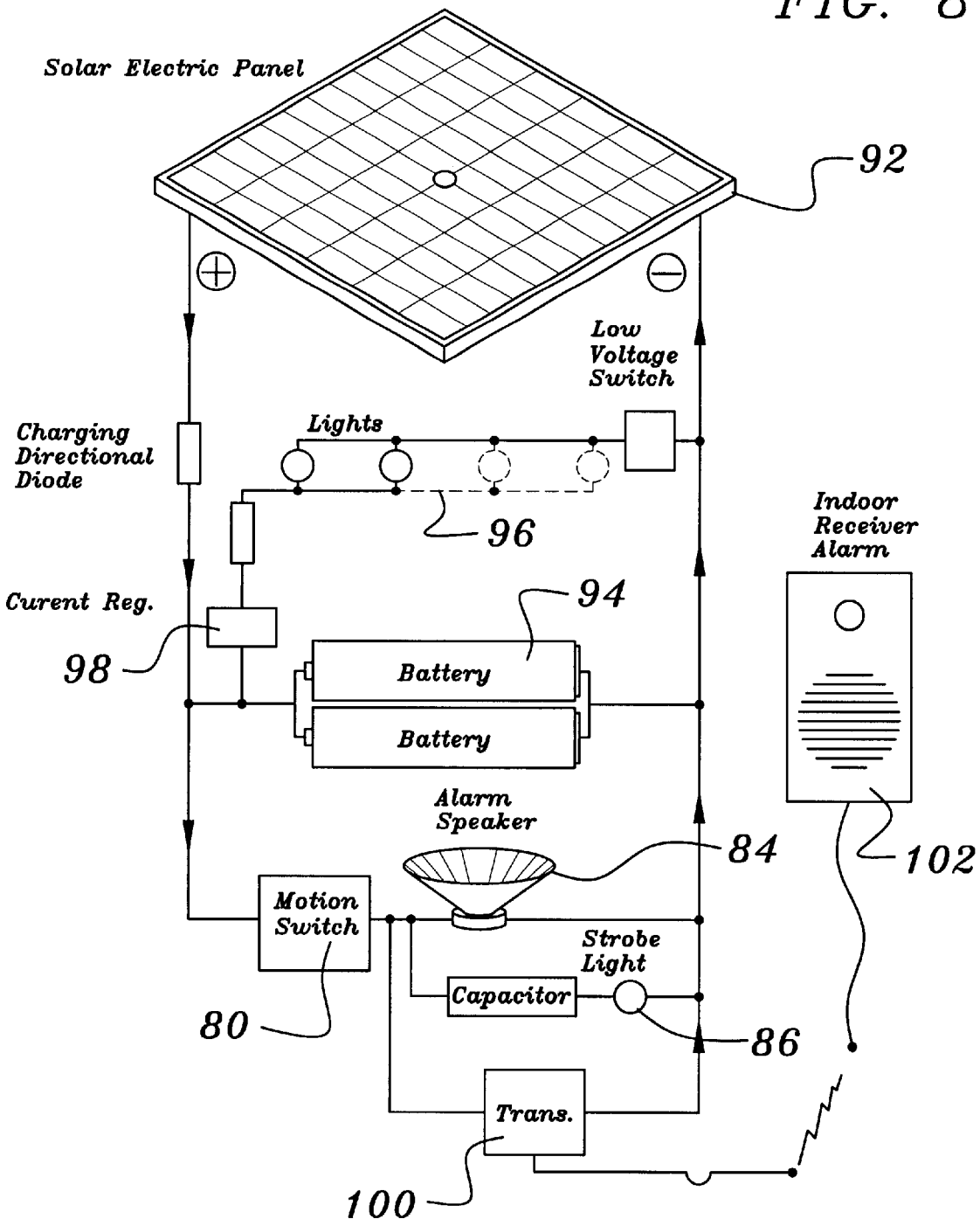
FIG. 8 is a schematic diagram of another electronic embodiment of the theft deterrent outdoor lighting of this invention that further includes a transmitter for transmitting the alarm signal to an indoor receiver alarm.

As noted above, the theft deterrent outdoor lighting 20 of this invention may be incorporated into our "Solar Powered Light Assembly" invention described in our patent application filed concurrently herewith. FIG. 8 is a schematic diagram of the electrical embodiment of the theft deterrent outdoor lighting 20 of this invention incorporated into our solar-powered light assembly in which a solar photovoltaic array 92 supplies electrical energy to charge one or more batteries 94 during daylight such that, at night, the stored electrical energy in the batteries power one or more low-powered lights 96 such as light-emitting diodes. In this embodiment, the electrical energy provided by the photovoltaic array 92 may be supplied to the batteries to maintain their charge. As only a trickle charge is necessary to maintain the charge on the battery 94, the amount of electrical energy consumed would not starve the solar-powered light assembly 20 of electrical energy to day-time charge its batteries. However, a light sensing switch 98 may be provided in series with the low-powered lights 96 to prevent them from daytime depleting the charge of the batteries needed for powering the alarm 84.

As shown in FIG. 8, another embodiment of the electronic theft deterrent outdoor lighting 20 of this invention may comprise a transmitter 100 that sends an alarm signal to an indoor receiver alarm 102 so as to alert the homeowner of a theft in progress. In this embodiment, the transmitter 100 is serially connected to the contacts of the motion detector 80 and batteries 94 such that upon detecting motion, the contacts of the motion detector 80 close to supply electrical energy from the batteries 94 to the transmitter 100 whereupon the alarm signal is transmitted and received by the indoor receiver alarm 102 to sound its alarm.

Figure 9:
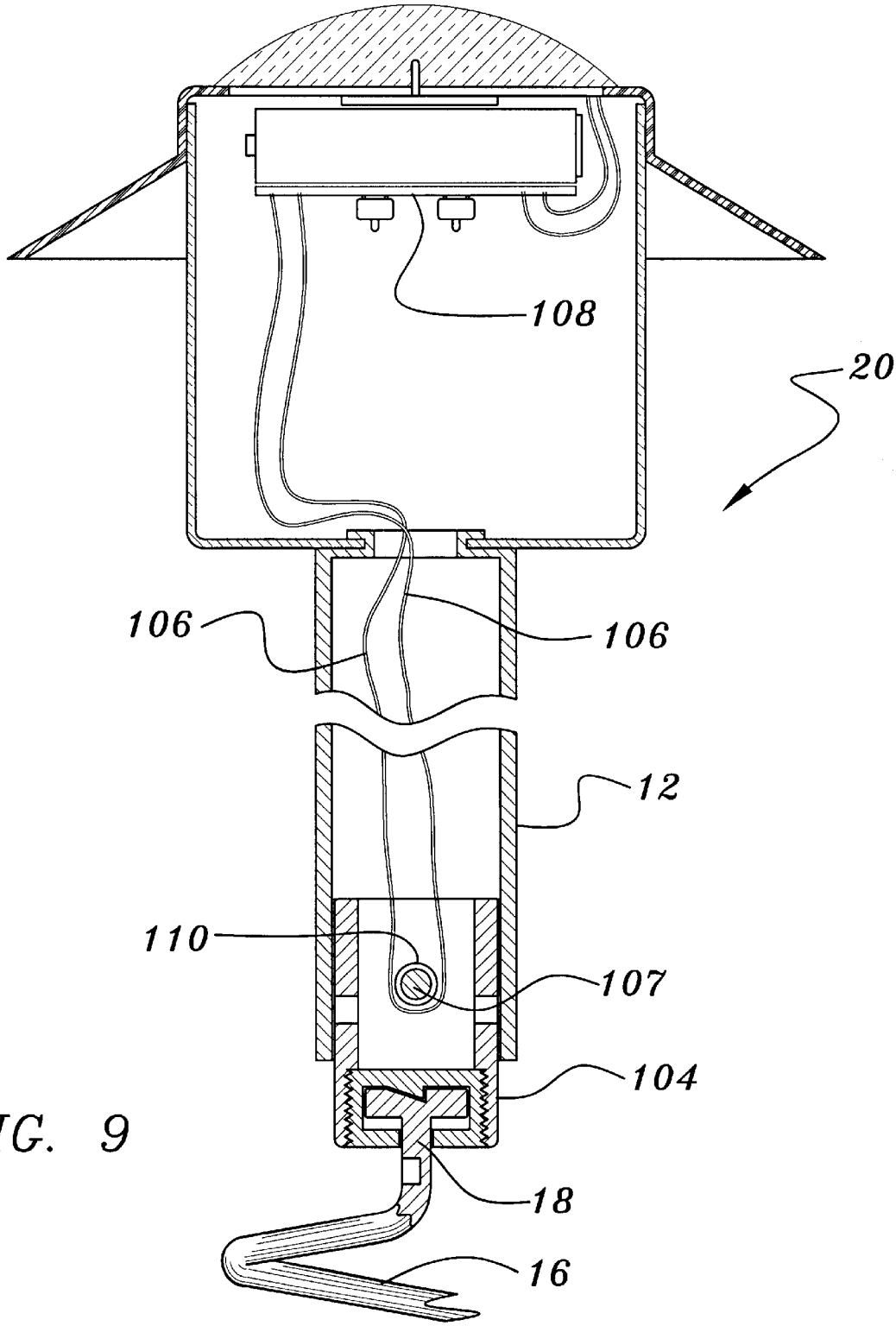
FIG. 9 is a partial cross-sectional view of the outdoor lightning assembly of the invention that includes the severable wiring harness that is destructively severed if the event the lighting is stolen by pulling it from the ground.

FIG. 9 is a partial cross-sectional view of another embodiment of the theft-deterrent outdoor lighting 20 of the invention. More particularly, in this embodiment, the base 104 of the auger comprises a generally non-cylindrical design that is dimensioned to slidably receive the lower end of the elongated support 12 and prevent relative rotation therebetween. A transverse pin 106 extends through opposing holes 110 in the side walls of the base 104. The wiring harness, generally represented by numeral 106, is threaded down and around the pin 106 and then back up to the associated electronics 108. Base 104 is coupled to a one-way clutch 18 that is in turn coupled to the auger 16 for allowing auguring the lighting 20 into the ground. In the event that the lighting assembly 20 is grasped and attempted to be jerked or otherwise pulled from the ground, the wiring harness 106 that is entrained around the pin 106 is pulled out, thereby severing all of the leads. The lighting assembly 20 is thus destroyed. That the lighting assembly 20 is destroyed in the event of theft, should be a sufficient deterrent to theft.

Figure 10:
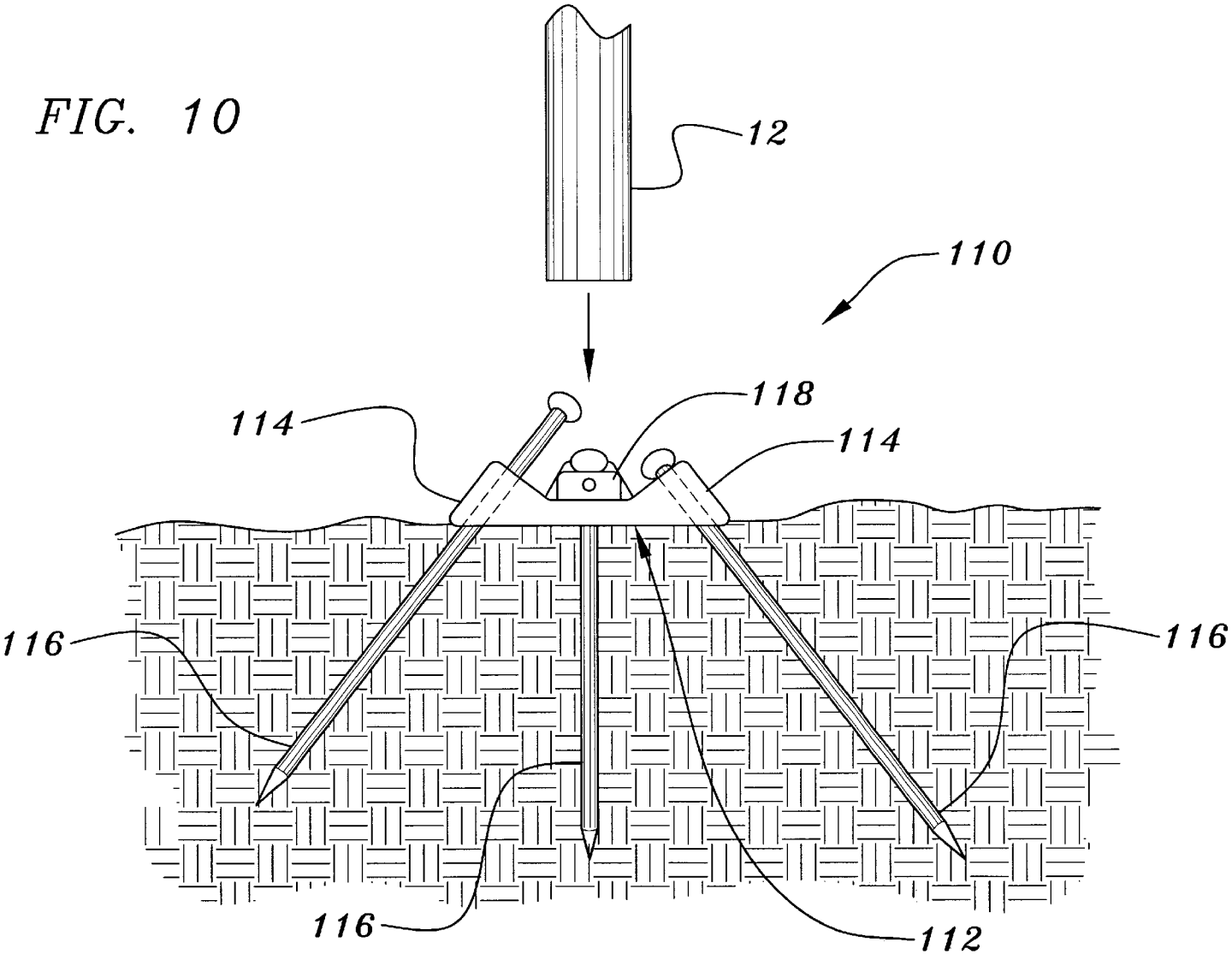
FIG. 10 is a side elevational view of a ground anchor that comprises a mushroom configuration once installed in the ground.

It is noted that in many of the above-described embodiments, a ground anchor having a mushroom configuration may be employed in lieu of the auger 16. One exemplary type of ground anchor 110 is shown in FIG. 10. The anchor 110 comprises a base 112 having a plurality of outwardly angled apertures 114 that are dimensioned to receive elongated spikes 116 therethrough. During use, the base 112 is positioned on the ground in the desired location of the lighting 20. Spikes 116 are driven through their respective apertures 114 into the ground. Once all of the spikes 116 are in position, a mushroom configuration is created, thereby rendering the base 112 difficult to remove. The elongated support 12 is then snap-fitted over a corresponding boss 118 to prevent access to the heads of the spikes 116 that would otherwise allow them to be removed. As the spikes 116 cannot be removed, the lighting 20 is difficult to remove from the ground.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A theft deterrent outdoor lighting, comprising in combination:

a light housing for housing a light;

an auger having a thread for augering into the ground;

a one-way clutch interconnecting said auger relative to said light housing, said one-way clutch fixedly connecting said light housing relative to said auger when turned in the same direction as said thread of said auger and for allowing said light housing to free-wheel relative to said auger when turned in a direction opposite to said thread of said auger, whereby said theft deterrent outdoor lighting may be easily augered into the ground but not easily removed, thereby deterring theft of said theft deterrent outdoor lighting.

2. The theft deterrent outdoor lighting as set forth in claim 1, wherein said thread comprises a wire thread.

3. The theft deterrent outdoor lighting as set forth in claim 1, wherein said thread comprises a solid thread.

4. The theft deterrent outdoor lighting as set forth in claim 1, wherein said one-way clutch comprises a base into which said light housing is fitted and a mechanism that fixedly interconnects said base to said auger when rotation is in said same direction as said thread of said auger and allows free-wheeling when rotated in said direction opposite to said thread of said auger.

5. A theft deterrent outdoor lighting, comprising in combination:

a light housing for housing a light;

an anchor for positioning into the ground, said anchor having a base, a portion of which may be engaged through the use of a tool to allow said anchor to be anchored into the ground; and an elongated support interconnecting said light housing and said base to render said portion of said base non-engageable by the tool, whereby said theft deterrent outdoor lighting may be easily anchored into the ground but not easily removed, thereby deterring theft of said theft deterrent outdoor lighting.

6. The theft deterrent outdoor lighting as set forth in claim 5, wherein said elongated support comprises a snap-fit onto said base to permit free-wheeling of said elongated base relative to said base.

7. The theft deterrent outdoor lighting as set forth in claim 6, wherein said base comprises a wall through which a transverse hole is formed to allow engagement by the tool.

8. The theft deterrent outdoor lighting as set forth in claim 6, wherein said elongated support covers said transverse hole when snap-fitted onto said base.

9. The theft deterrent outdoor lighting as set forth in claim 6, wherein said snap-fit comprises a clog that engages under an inturned end of said elongated support to secure said elongated support to said base to prevent removal thereof and to permit relative rotation thereof.

10. The theft deterrent outdoor lighting as set forth in claim 6, wherein said anchor further comprises at least one spike extending through said base into the ground to secure said base into the ground.

11. The theft deterrent outdoor lighting as set forth in claim 5, wherein said anchor comprises a mushroom configuration once positioned in the ground.

12. A theft deterrent outdoor lighting, comprising in combination:

a light housing for housing a light;

an auger having a point;

an auger collar rotatably received on said auger, said auger collar having an auger thread for threading into the ground, said auger collar being fixedly connected to said auger when said auger is turned in the same direction as said thread and not being fixedly connected to said auger when turned in a direction opposite of said thread, whereby said theft deterrent outdoor lighting may be easily augured into the ground but not easily removed, thereby deterring theft of said theft deterrent outdoor lighting.

13. The theft deterrent outdoor lighting as set forth in claim 12, wherein said auger comprises a stop pin that engages said auger collar when said auger is turned in said same direction as said thread.

14. The theft deterrent outdoor lighting as set forth in claim 13, wherein said auger collar comprise a sloped slot that engages said stop pin when said auger when turned in said same direction as said thread.

15. The theft deterrent outdoor lighting as set forth in claim 14, wherein said auger collar is allowed to slide along a portion of a length of said auger between said stop pin and said point.

16. A theft deterrent outdoor lighting, comprising in combination:

a light housing for housing a light;

an anchor for positioning into the ground, said anchor having a base, a portion of which may be engaged through the use of a tool to allow said anchor to be positioned into the ground;

an elongated support removably interconnecting said light housing and said base; and an electrical wiring harness being connected to said anchor that is severed should said elongated support be pulled from said base, whereby said theft deterrent outdoor lighting may be easily positioned into the ground and is destroyed if removed, thereby deterring theft of said theft deterrent outdoor lighting.

17. The theft deterrent outdoor lighting as set forth in claim 16, wherein said base comprises a wall through which a transverse hole is formed to allow engagement by the tool.

18. The theft deterrent outdoor lighting as set forth in claim 17, wherein said wiring harness is threaded around a pin in said base such that said wiring harness is severed should the elongated support be removed from said base.

19. The theft deterrent outdoor lighting as set forth in claim 17, wherein said elongated support covers said transverse hole when fitted onto said base.

* * * * *